US011322082B2

(12) United States Patent
Hu et al.

(10) Patent No.: US 11,322,082 B2
(45) Date of Patent: May 3, 2022

(54) PIXEL DRIVING CIRCUIT INCLUDING COMPENSATION ELEMENTS AND METHOD AND DISPLAY DEVICE

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Shuang Hu, Beijing (CN); Tae Yup Min, Beijing (CN); Zhi Zhang, Beijing (CN); Shuai Chen, Beijing (CN); Qian Qian, Beijing (CN); Xiuzhu Tang, Beijing (CN); Zhenguo Tian, Beijing (CN); Jingpeng Zhao, Beijing (CN); Xing Dong, Beijing (CN); Taoliang Tang, Beijing (CN); Lijun Xiong, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 537 days.

(21) Appl. No.: 16/332,449

(22) PCT Filed: Sep. 11, 2018

(86) PCT No.: PCT/CN2018/104937

§ 371 (c)(1),
(2) Date: Mar. 12, 2019

(87) PCT Pub. No.: WO2019/052435

PCT Pub. Date: Mar. 21, 2019

(65) Prior Publication Data

US 2021/0358404 A1 Nov. 18, 2021

(30) Foreign Application Priority Data

Sep. 15, 2017 (CN) ..... 201710840527.9

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01);
(Continued)

(58) Field of Classification Search
None
See application file for complete search history.

(56) References Cited

U.S. PATENT DOCUMENTS 8,362,984 B2 1/2013 Le Roy et al.
2006/0232678 A1* 10/2006 Choi ..... G09G 3/3275 348/207.11
(Continued)

FOREIGN PATENT DOCUMENTS

CN 105825815 A 8/2016
CN 106097965 A 11/2016
(Continued)

OTHER PUBLICATIONS

Search Report and Written Opinion for International Application No. PCT/CN2018/104937 dated Nov. 30, 2018.

*Primary Examiner* — Kirk W Hermann
(74) *Attorney, Agent, or Firm* — Calfee, Halter & Griswold LLP

(57) ABSTRACT

A pixel driving circuit includes a first switching element, a second switching element, a first compensation element, a
(Continued)

second compensation element, a driving transistor, a capacitor, and a third switching element.

14 Claims, 7 Drawing Sheets

(52) U.S. Cl.
CPC ..... *G09G 2300/0842* (2013.01); *G09G 2320/0233* (2013.01)

(56) References Cited

U.S. PATENT DOCUMENTS

| | | | | |
|---|---|---|---|---|
| 2009/0015575 | A1 | 1/2009 | Le Roy et al. | |
| 2015/0130859 | A1* | 5/2015 | Yang ..... | G09G 3/3233 345/690 |

FOREIGN PATENT DOCUMENTS

| | | | |
|---|---|---|---|
| CN | 106531079 | A | 3/2017 |
| CN | 106782318 | A | 5/2017 |
| CN | 107123396 | A | 9/2017 |
| EP | 1964094 | B1 | 4/2010 |
| WO | 2018113324 | A1 | 6/2018 |
| WO | 2018113361 | A1 | 6/2018 |

* cited by examiner

PIXEL DRIVING CIRCUIT INCLUDING COMPENSATION ELEMENTS AND METHOD AND DISPLAY DEVICE

CROSS REFERENCE

The present application is a 35 U.S.C. 371 national stage application of International Application No. PCT/CN2018/104937, filed on Sep. 11, 2018, which is based upon and claims priority to Chinese Patent Application No. 201710840527.9, filed on Sep. 15, 2017, and the entire contents thereof are incorporated herein by reference.

TECHNICAL FIELD

The present disclosure relates to display technologies, and particularly to a driver module for a display panel, a display panel including the driver module, and a display device including the display panel.

BACKGROUND

As a current-type light-emitting device, Organic Light Emitting Diode (OLED) is increasingly used high performance display technical fields for its self-illumination, fast response, wide viewing angle, and its ability to be fabricated on flexible substrates. OLED display devices can be classified into two types: PMOLED (Passive Matrix Driving OLED) and AMOLED (Active Matrix Driving OLED). AMOLED has gained increasing attention from display technology developers due to its low manufacturing cost, high response speed, power saving, its ability for being used in DC drive for portable devices, and large operating temperature range.

In the existing AMOLED display panels, each light emitting pixel has an independent pixel driving circuit for supplying driving current for the light emitting pixel. However, under the driving action of the conventional pixel driving circuit, the uniformity of light emitted by OLEDs in pixels in the AMOLED display panels needs to be improved.

It should be noted that the information disclosed in the Background section above is only for enhancing the understanding of the background of the present disclosure, and thus may include information that does not constitute prior art known to those of ordinary skill in the art.

SUMMARY

Embodiments of the present disclosure provide a pixel driving circuit, a pixel driving method and a display device.

According to a first aspect of the present disclosure, there is provided a pixel driving circuit, including:

a first switching element, wherein a control terminal of the first switching element receives a first scan signal, a first terminal of the first switching element is connected to a first node, and a second terminal of the first switching element receives a data signal;

a second switching element, wherein a control terminal of the second switching element receives a second scan signal, a first terminal of the second switching element is connected to a second node, and a second terminal of the second switching element receives the data signal;

a first compensation element, wherein a control terminal of the first compensation element is connected to the second node, and a second terminal of the first compensation element receives a first power signal;

a second compensation element, wherein a control terminal and a first terminal of second compensation element are both connected to the first node, and a second terminal of second compensation element is connected to the first terminal of the first compensation element;

a driving transistor, where a control terminal of the driving transistor is connected to the first node, a first terminal of the driving transistor is connected to a first electrode of an electroluminescent element, and a second terminal of the driving transistor receives the first power signal;

a capacitor, wherein a first terminal of the capacitor is connected to the control terminal of the driving transistor, and a second terminal of the capacitor is connected to the first terminal of the driving transistor;

a third switching element, wherein a control terminal of the third switching element receives a third scan signal, a first terminal of the third switching element is connected to a second electrode of the electroluminescent element and receives a second power signal, and a second terminal of the third switching element is connected to the first terminal of the driving transistor;

wherein turn-on levels of the first compensation element and the second compensation element are opposite to turn-on levels of the first switching element, the second switching element, the driving transistor, and the third switching element.

In an exemplary embodiment of the present disclosure, the pixel driving circuit is connected to an N-th scan signal line and an (N+1)-th scan signal line, the N-th scan signal line is configured to output the second scan signal, and the (N+1)-th scan signal line is configured to output the third scan signal; where N is a positive integer.

In an exemplary embodiment of the present disclosure, the switching elements and the driving transistor are N-type thin film transistors, and the compensation elements are P-type thin film transistors.

In an exemplary embodiment of the present disclosure, the switching elements and the driving transistor are P-type thin film transistors, and the compensation elements are N-type thin film transistors.

In an exemplary embodiment of the present disclosure, the thin film transistors are one of amorphous silicon thin film transistors, polycrystalline silicon thin film transistors, and amorphous-indium gallium zinc oxide thin film transistors.

According to another aspect of the present disclosure, there is provided a pixel driving method for driving the pixel driving circuit as described above, wherein the pixel driving method includes:

in a reset phase where the first scan signal and the third scan signal are both at a first level, and the second scan signal, the data signal and the first power signal are both at a second level, turning on the first switching element by the first scan signal to transmit the data signal to the first node, so that the second compensation element is turned on under action of the data signal, and turning on the third switching element by the third scan signal to transmit the second power signal to the second node so that the first compensation element is turned on under action of the second power signal;

in a pre-charging phase where the first scan signal, the third scan signal, the data signal, and the first power signal are all at the first level and the second scan signal is at the second level, turning on the first switching element by the first scan signal to transmit the data signal to the first node to charge the capacitor, turning off the second compensation element under action of the data signal, turning on the third switching element by the third scan signal to transmit the second power signal to the second node, so that the first compensation element is turned on under action of the second power signal;

in a writing phase where the first scan signal, the second scan signal and the data signal are all at the second level, and the third scan signal and the first power signal are both at the first level, turning on the third switching element by the third scan signal to transmit the second power signal to the second node, so that the first compensation element is turned on under action of the second power signal, turning on the driving transistor under action of the data signal stored in the capacitor, so that the data signal stored in the capacitor is dropped to a threshold voltage of the driving transistor through the driving transistor;

in a bootstrap light-emitting phase where the second scan signal, the data signal, and the first power signal are all at the first level, and the first scan signal and the third scan signal are at the second level, turning on the second switching element by the second scan signal, so that the data signal is transmitted to the second node, and bootstrapping a signal of the first node from the threshold voltage of the driving transistor to a sum of the threshold voltage of the driving transistor and the data signal under bootstrap of the capacitor, and turning on the driving transistor by the signal of the first node, so that the driving transistor outputs driving current under action of the first power signal to make the electroluminescent element emits light;

wherein the first switching element to the third switching element and the driving transistor are turned on under action of the first level, the first compensation element and the second compensation element are turned off under action of the first level, the first switching element to the third switching element and the driving transistor are turned off under action of the second level, and the first compensation element and the second compensation element are turned on under action of the second level.

In an exemplary embodiment of the present disclosure, the switching elements and the driving transistor are N-type thin film transistors, the compensation elements are P-type thin film transistors, the first level is a high level and the second level is a low level.

In an exemplary embodiment of the present disclosure, the switching elements and the driving transistor are P-type thin film transistors, the compensation elements are N-type thin film transistors, the first level is a low level, and the second level is a high level.

In an exemplary embodiment of the present disclosure, the thin film transistors are one of amorphous silicon thin film transistors, polycrystalline silicon thin film transistors, and amorphous-indium gallium zinc oxide thin film transistors.

According to an aspect of the present disclosure, there is provided a display device including the pixel drive circuit as described above.

BRIEF DESCRIPTION OF THE DRAWINGS

The drawings, which are incorporated in the specification and constitute a part of the specification, show exemplary embodiments of the present disclosure. The drawings along with the specification explain the principles of the present disclosure. It is apparent that the drawings in the following description show only some of the embodiments of the present disclosure, and other drawings may be obtained by those skilled in the art without departing from the drawings described herein.

DETAILED DESCRIPTION

Figure 1:
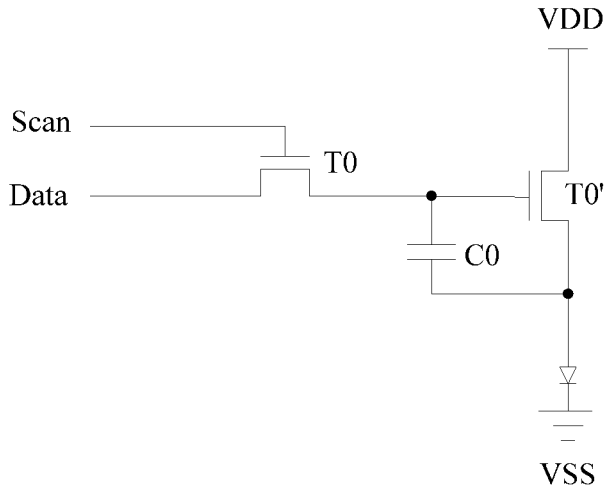
FIG. 1 is a schematic diagram of a pixel driving circuit with a conventional 2T1C structure.

Example embodiments will now be described more fully with reference to the accompanying drawings. However, the example embodiments can be embodied in a variety of forms and should not be construed as being limited to the examples set forth herein; rather, these embodiments are provided so that the present disclosure will be more comprehensive and complete, and the conception of the example embodiments will be conveyed to those skilled in the art fully. The described features, structures, or characteristics may be combined in one or more embodiments in any suitable manner. In the following description, numerous specific details are set forth to facilitate understanding of embodiments of the present disclosure. However, one skilled in the art will appreciate that the technical solutions of the present disclosure may be implemented when one or more of the specific details are omitted, or other methods, components, devices, steps, and the like may be employed. In other instances, the well-known technical solutions would not be shown or described in detail so as to avoid various aspects of the present disclosure to be obscured.

In addition, the drawings are merely schematic illustrations of the present disclosure, and are not necessarily drawn to scale. The same reference numerals in the drawings denote the same or similar parts, and repeated description thereof will be omitted.

As shown in FIG. 1, a conventional pixel driving circuit includes a transistor T0, a transistor T0', and a capacitor C0. That is, the pixel driving circuit has a 2T1C structure. The transistor T0 is used to receive a scan signal Scan and a data signal Data, and the transistor T0' is used as a driving transistor. The formula for calculating the driving current of the pixel driving circuit is:

$$Ion=K\times(Vgs-Vth)^2=K\times(Vg-Vs-Vth)2=K\times(Data-VDD-Vth)^2.$$

As can be seen from the above the above formula for calculating the driving current, the magnitude of the driving current Ion in the conventional pixel driving circuit is related to the threshold voltage Vth of the driving transistor. However, due to the process variations of the transistors and the long-time operation, there may be shift in the threshold voltage Vth of transistors and the threshold voltage Vth of transistors may not be consistent. It can be seen from the above calculation formula of the driving current that the shift and inconsistency of the transistor threshold voltage Vth can cause the driving current to be inconsistent, resulting in low uniformity of OLED illumination in each pixel in the AMOLED display panel when the conventional pixel driving circuit is used.

Figure 2:
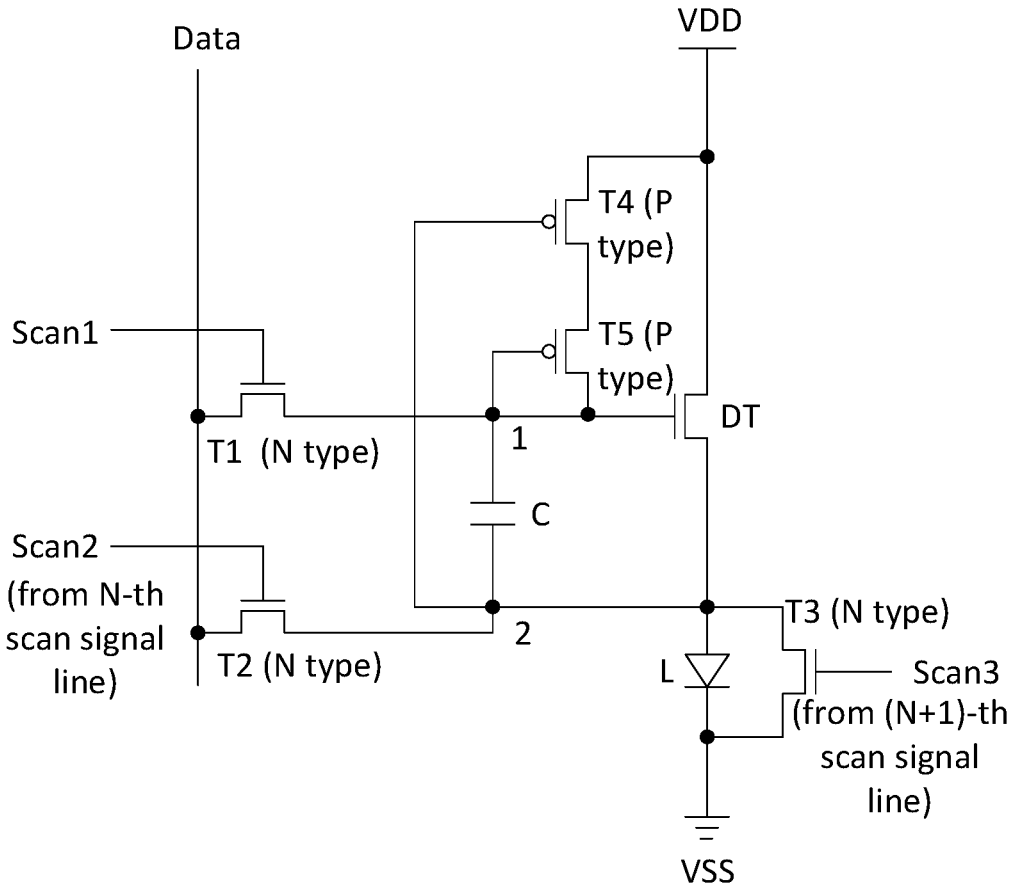
FIG. 2 is a schematic diagram of a pixel driving circuit provided according to an exemplary embodiment of the present disclosure.

An exemplary embodiment of the present disclosure provides a pixel driving circuit, which can be used to drive an electroluminescent element. As shown in FIG. 2, the pixel driving circuit includes a first switching element T1, a second switching element T2, a first compensation element T4, a second compensation element T5, a driving transistor DT, a capacitor C, and a third switching element T3.

A control terminal of the first switching element T1 receives a first scan signal Scan1, a first terminal of the first switching element T1 is connected to a first node 1, and a second terminal of the first switching element T1 receives a data signal Data.

A control terminal of the second switching element T2 receives a second scan signal Scan2, a first terminal of the second switching element T2 is connected to a second node 2, and a second terminal of the second switching element T2 receives the data signal Data.

A control terminal of the first compensation element T4 is connected to the second node 2, and a second terminal of the first compensation element T4 receives a first power signal VDD.

A control terminal and a first terminal of second compensation element T5 are both connected to the first node 1, and a second terminal of second compensation element T5 is connected to the first terminal of the first compensation element T4.

A control terminal of the driving transistor DT is connected to the first node 1, a first terminal of the driving transistor DT is connected to a first electrode of an electroluminescent element L, and a second terminal of the driving transistor DT receives the first power signal VDD.

A first terminal of the capacitor C is connected to the control terminal of the driving transistor DT, and a second terminal of the capacitor C is connected to the first terminal of the driving transistor DT.

A control terminal of the third switching element T3 receives a third scan signal Scan3, a first terminal of the third switching element T3 is connected to a second electrode of the electroluminescent element L and receives a second power signal VSS, and a second terminal of the third switching element T3 is connected to the first terminal of the driving transistor DT.

Turn-on levels of the first compensation element T4 and the second compensation element T5 are opposite to turn-on levels of the first switching element T1, the second switching element T2, the driving transistor DT, and the third switching element T3.

In the present exemplary embodiment, the electroluminescence element L is a current-driven electroluminescence element which is controlled to emit light by a current flowing through the driving transistor DT. For example, the electroluminescence element L is an OLED. However, electroluminescence element L in exemplary embodiments of the present disclosure is not limited to this. Further, the electroluminescent element L has a first electrode and a second electrode. For example, the first electrode of the electroluminescent element L can be an anode and the second electrode of the electroluminescent element L can be a cathode. For another example, the first electrode of the electroluminescent element L can be a cathode, and the second electrode of the electroluminescent element L can be an anode.

The first to third switching elements T1 to T3 may correspond to the first to third switching transistors, respectively. Each of the switching transistors has a control terminal, a first terminal, and a second terminal. For example, the control terminal of each switching transistor may be a gate, the first terminal of each switching transistor may be a source, and the second terminal of each switching transistor may be a drain. For another example, the control terminal of each switching transistor may be a gate, the first terminal of each switching transistor may be a drain, and the second terminal of each switching transistor may be a source. In addition, each of the switching transistors may be an enhancement transistor or a depletion transistor, which is not specifically limited in exemplary embodiments of the present disclosure. It should be noted that since the source and the drain of a switching transistor are symmetrical, the sources and the drains of the first to third switching transistors T1 to T3 are interchangeable.

The first compensation element T4 and the second compensation element T5 may correspond to the first compensation transistor and the second compensation transistor, respectively. Each of the compensation transistors has a control terminal, a first terminal and a second terminal. For example, the control terminal of each compensation transistor may be a gate, the first terminal of each compensation transistor may be a source, and the second terminal of each compensation transistor may be a drain. For another example, the control terminal of each compensation transistor may be a gate, the first terminal of each compensation transistor may be a drain, and the second terminal of each compensation transistor may be a source. In addition, each of the compensation transistors may be an enhancement compensation transistor or a depletion compensation transistor, which is not specifically limited in exemplary embodiments of the present disclosure. It should be noted that since the source and the drain of each compensation transistor are symmetric, the sources and the drains of the first compensation transistor T4 and the second compensation transistor T5 are interchangeable.

The driving transistor DT has a control terminal, a first terminal, and a second terminal. For example, the control terminal of the driving transistor DT may be a gate, the first terminal of the driving transistor DT may be a source, and the second terminal of the driving transistor DT may be a drain. For another example, the control terminal of the driving transistor DT may be a gate, the first terminal of the driving transistor DT may be a drain, and the second terminal of the driving transistor DT may be a source. In addition, the driving transistor DT may be an enhancement driving transistor or a depletion driving transistor, which is not particularly limited in this exemplary embodiment.

The type of the capacitor C can be selected depending on specific circuits. For example, the capacitor C may be a MOS capacitor, a metal capacitor, or a double poly-silicon capacitor, and so on, which is not specifically limited in this exemplary embodiment.

The turn-on levels of the first compensation element T4 and the second compensation element T5 and the turn-on levels of the first switching component T1, the second switching component T2, the driving transistor DT, and the third switching component T3 are opposite. In other words, when the turn-on levels of the first compensation element T4 and the second compensation element T5 (i.e., the levels which enable the first compensation element T4 and the second compensation element T5 to be turned on) are a high level, the turn-on levels of the first switching element T1, the second switching element T2, the third switching element T3, and the driving transistor DT are a low level; when the turn-on levels of the first compensation element T4 and the second compensation element T5 are a low level, the turn-on levels of the first switching element T1, the second switching element T2, the third switching element T3, and the driving transistor DT are a high level. Based on this, when the switching elements and the driving transistor DT are N-type thin film transistors, the compensation elements are all P-type thin film transistors, that is, the first switching element T1, the second switching element T2, and the third switching element T3 and the driving transistor DT are N-type thin film transistors, the first compensation element T4 and the second compensation element T5 are P-type thin film transistors. Alternatively, the switching elements and the driving transistor DT are P-type thin film transistors, the compensation elements are N-type thin film transistors, that is, when the first switching element T1, the second switching element T2, the third switching element T3 and the driving transistor DT are P-type thin film transistors, the first compensation element T4 and The second compensation element T5 are N-type thin film transistors. Further, the types of the above thin film transistors can be selected according to the specific requirements of the circuit. For example, the thin film transistors may be one of amorphous silicon thin film transistors, poly-silicon thin film transistor, and amorphous-indium gallium zinc oxide thin film transistors, which is not particularly limited in the exemplary embodiment.

The pixel driving circuit provided in the exemplary embodiment of the present disclosure includes the first switching element T1, the second switching element T2, the first compensation element T4, the second compensation element T5, the driving transistor DT, the capacitor C, and the third switching element T3. During the operation of the pixel driving circuit, in a pre-charging phase, the capacitor C is charged by the data signal Data; in a writing phase, the driving transistor DT is turned on by the data signal Data stored in the capacitor C, so that the data signal Data stored in the capacitor C is dropped by the driving transistor DT to the threshold voltage Vth of the driving transistor DT to write the threshold voltage Vth of the driving transistor DT to the first node 1, thereby eliminating the influence of the threshold voltage Vth of the driving transistor DT on the driving current and ensuring the uniformity of the display brightness of each pixel. On the other hand, in a reset phase, the first switching element T1 and the third switching element T3 are turned on by the first scan signal Scan1 and the third scan signal Scan3 to transmit the data signal Data is to the first node 1, and to transmit the second power signal VSS to the second node 2 to reset the first node 1 by the data signal Data (i.e., discharge the capacitor C), and to reset the second node 2 by the second power signal VSS, thereby eliminating the influence of the previous frame signal on the display brightness.

In a plurality of pixel driving circuits arranged in an array, in order to make each pixel driving circuit reuse the second scan signal Scan2 and the third scan signal Scan3 to simplify the circuit structure of the plurality of pixel driving circuits arranged in the array and realize row-by-row scan, the pixel driving circuit is connected to an N-th row scan signal line and an (N+1)-th row scan signal line. The N-th row scan signal line is used for outputting the second scan signal Scan2, and the (N+1)-th row scan signal line is used for outputting the third scan signal Scan3; where N is a positive integer. Specifically, the control terminal of the second switching element T2 in the pixel driving circuit is connected to the N-th scan signal line, and the control terminal of the third switching element T3 in the pixel driving circuit is connected to the (N+1)-th scan signal line.

Figure 8:
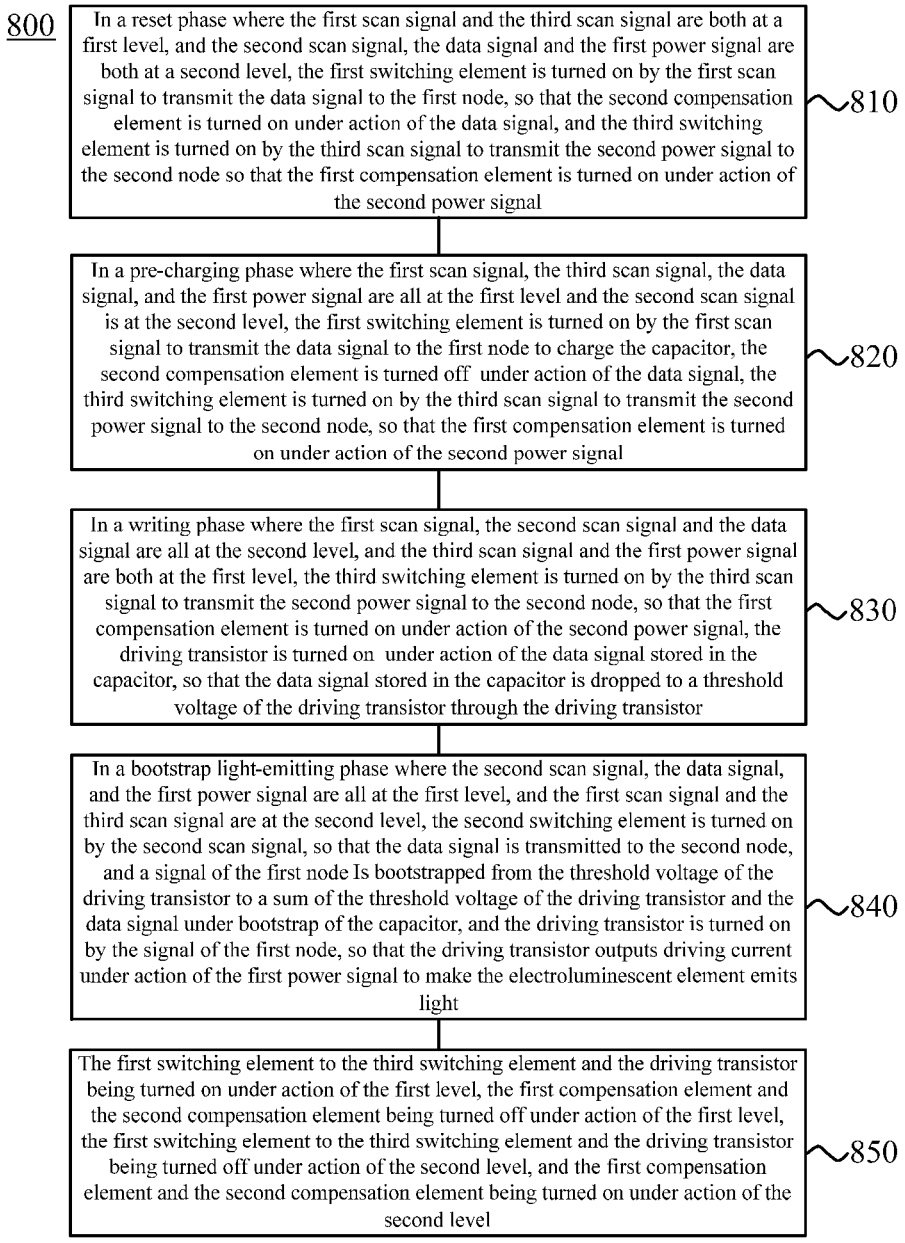
FIG. 8 is a flowchart of pixel driving method for driving the pixel driving circuit according to an exemplary embodiment of the present disclosure.
Figure 9:
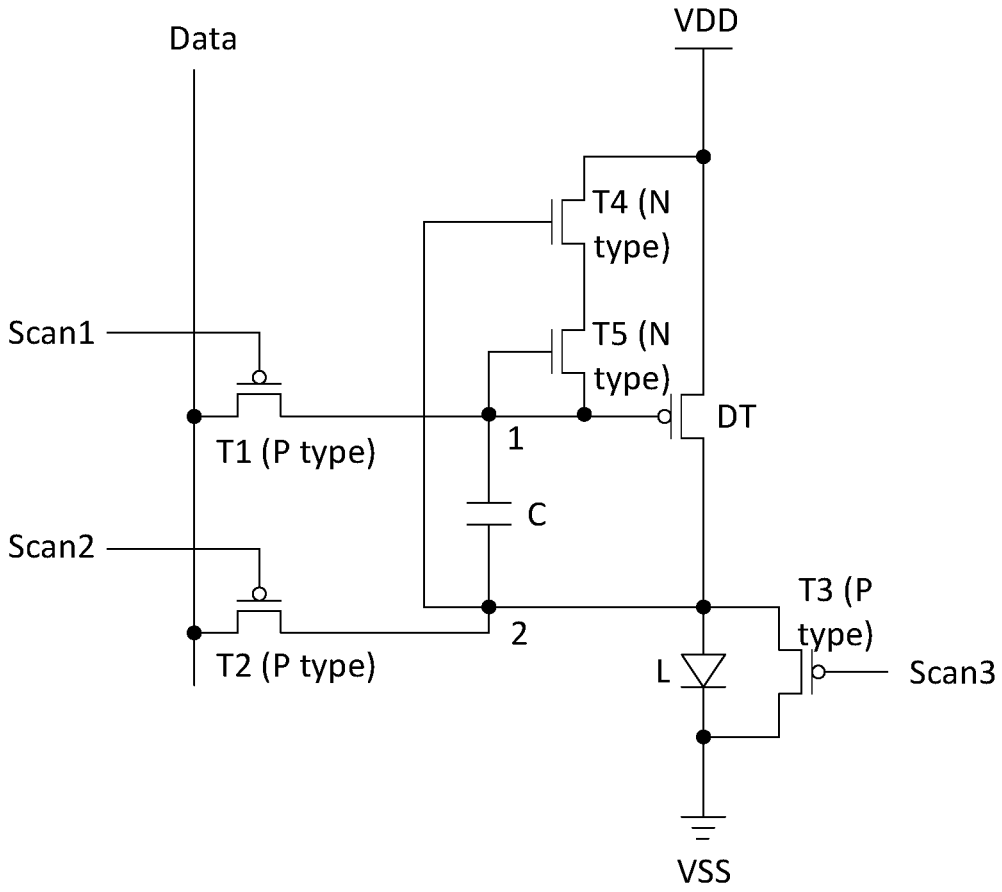
FIG. 9 is a schematic diagram of a pixel driving circuit provided according to an exemplary embodiment of the present disclosure.

In an exemplary embodiment of the present disclosure, there is also provided a pixel driving method for driving the pixel driving circuit as described in FIG. 2. The pixel driving method can include the following four stages, as shown in FIG. 8:

In a reset phase, the first scan signal Scan1 and the third scan signal Scan3 are both at a first level, and the second scan signal Scan2, the data signal Data, and the first power signal VDD are both at a second level. The first switching element T1 is turned on by the first Scan signal Scan1 to transmit the data signal Data to the first node 1 to cause second compensation element T5 to be turned on under action of the data signal Data; the third switching element T3 is turned on by the third scan signal Scan3 to transmit the second power signal VSS to the second node 2, so that the first compensation element T4 is turned on under the action of the second power signal VSS.

In a pre-charging phase, the first scan signal Scan1, the third scan signal Scan3, the data signal Data, and the first power signal VDD are all at the first level, and the second scan signal Scan2 is at the second level. The first switching element T1 is turned on by the first scan signal Scan1 to transmit the data signal Data to the first node 1 to charge the capacitor C, and the second compensation element T5 is turned off by the data signal Data, and the third switching element T3 is turned on by the third scan signal Scan3 to transmit the second power signal VSS to the second node 2, such that the first compensation element T4 is turned on by the second power signal VSS.

In a writing phase, the first scan signal Scan1, the second scan signal Scan2, and the data signal Data are all the second level, and the third scan signal Scan3 and the first power signal VDD are all at the first level. The third switching element T3 is turned on by the third scan signal Scan3, so that the second power signal VSS is transmitted to the second node 2, so that the first compensation element T4 is turned on by the second power signal VSS, and the driving transistor DT is turned on by the data signal Data stored in the capacitor C, so that data signal Data stored in the capacitor C is dropped by the driving transistor DT to the threshold voltage Vth of the driving transistor DT.

In a bootstrap light-emitting phase, the second scan signal Scan2, the data signal Data, and the first power signal VDD are all at the first level, the first scan signal Scan1 and the third scan signal Scan3 are at the second level. The second switching element T2 is turned on by the second scan signal Scan2, so that the data signal Data is transmitted to the second node 2. Due to the bootstrap action of the capacitor C, the signal of the first node 1 is bootstrapped from a threshold voltage Vth of the driving transistor DT to a sum of the threshold voltage Vth of the driving transistor DT and the data signal Data, the driving transistor DT is turned on by the signal at the first node 1, and the driving transistor DT outputs the driving current under the action of the first power signal VDD to drive the electroluminescent element L to emit light.

The first switching element to the third switching element (T1~T3) and the driving transistor DT are turned on by the first level, the first compensation element T4 and the second compensation element T5 are turned off by the first level, the first to third switching elements (T1~T3) and the driving transistor DT are turned off by the second level, and the first compensation element T4 and the second compensation element T5 are turned on by the second level.

In the present exemplary embodiment, the switching elements (i.e., the first to third switching elements T1 to T3) and the driving transistor DT are N-type thin film transistors, and the compensation elements (i.e., the first compensation element T4 and the second compensation element T5) are P-type thin film transistors; the first level is a high level, and the second level is a low level. Alternatively, the switching elements (i.e., the first to third switching elements T1 to T3) and the driving transistor DT are P-type thin film transistors, and the compensation elements (i.e., the first compensation element T4 and the second compensation element T5) are N-type thin film transistors; the first level is a low level, and the second level is a high level. The thin film transistors may be one of amorphous silicon thin film transistors, polysilicon thin film transistors, and amorphous-indium gallium zinc oxide thin film transistors, which is not particularly limited in the exemplary embodiment.

Figure 3:
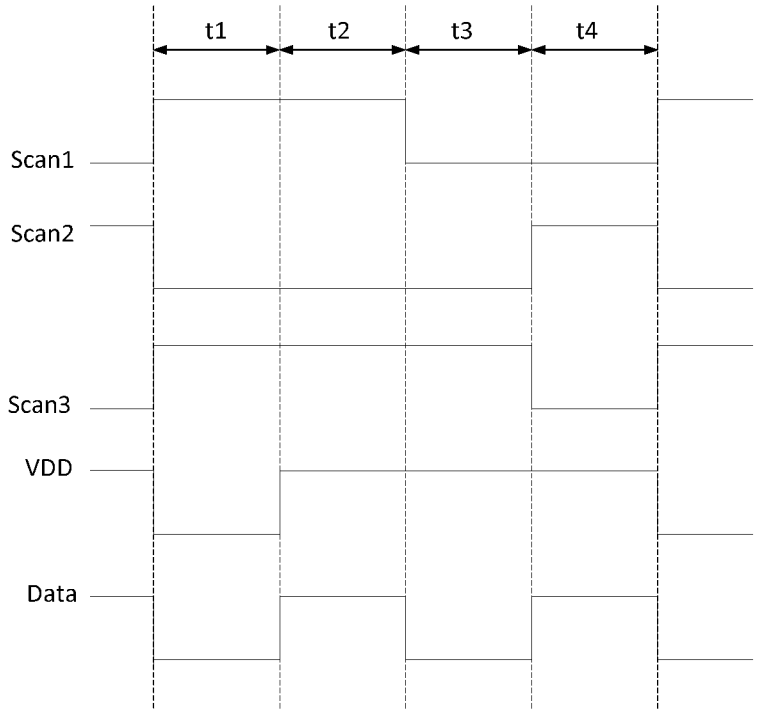
FIG. 3 is a timing chart showing the operation of a pixel driving circuit according to an exemplary embodiment of the present disclosure.

Hereinafter, the operation process of the pixel driving circuit in FIG. 2 will be described in detail in conjunction with the operation timing chart of the pixel driving circuit shown in FIG. 3. In the following descriptions, for example, the first switching element T1, the second switching element T2, the third switching element T3, and the driving transistor DT are all N-type thin film transistors, and the first compensation element T4 and the second compensation element T5 are P-type thin film transistors, and the first level is a high level and the second level is a low level. Since the first switching element T1, the second switching element T2, the third switching element T3, and the driving transistor DT are all N-type thin film transistors, the turn-on levels of the first switching element T1, the second switching element T2, the third switching element T3, and the driving transistor DT are high levels. Since the first compensation element T4 and the second compensation element T5 are both P-type thin film transistors, the turn-on levels of the first compensation element T4 and the second compensation element T5 are low levels. The driving timing chart shows the first scan signal Scan1, the second scan signal Scan2, the third scan signal Scan3, the first power signal VDD, and the data signal Data. It should be noted that the second power signal VSS is always at a low level.

Figure 4:
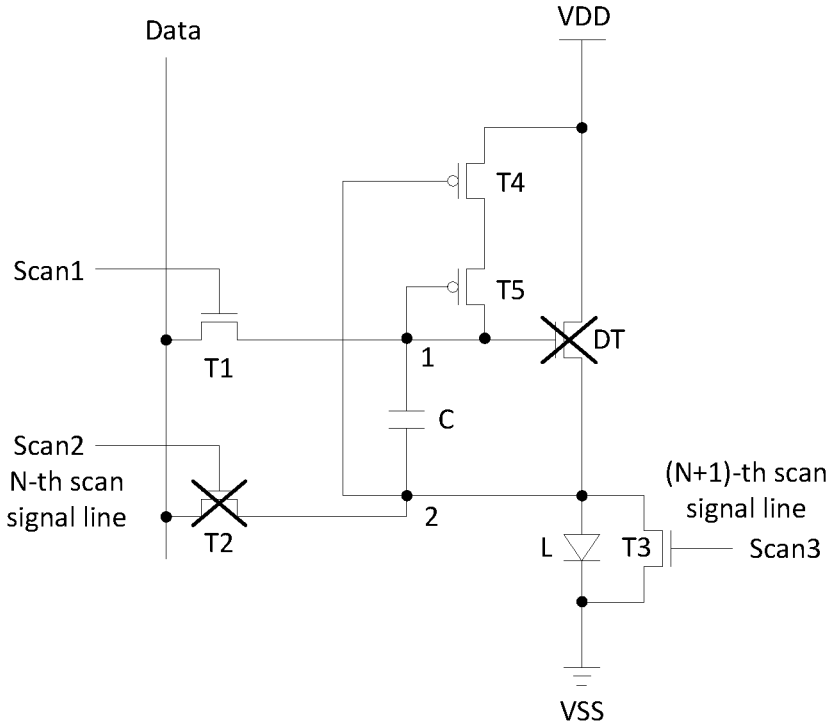
FIG. 4 is an equivalent circuit diagram of a pixel driving circuit in a reset phase according to an exemplary embodiment of the present disclosure.

In the reset phase (i.e., the t1 phase), the first scan signal Scan1 and the third scan signal Scan3 are both at a first level, and the second scan signal Scan2, the data signal Data, and the first power signal VDD are at a second level. The first switching element T1 is turned on by the first scan signal Scan1 to transmit the data signal Data to the first node 1, so that the second compensation element T5 is turned on under the action of the data signal Data; the third switching element T3 is turned on by the third scan signal Scan3 to transmit the second power signal VSS to the second node 2, so that the first compensation element T4 is turned on by the second power signal VSS. In the present exemplary embodiment, the first scan signal Scan1 and the third scan signal Scan3 are both at a high level, and the second scan signal Scan2, the data signal Data, and the first power signal VDD are both at a low level. As shown in FIG. 4, the first switching element T1 is turned on by the first scan signal Scan1, and the data signal Data is transmitted to the first node 1 through the first switching element T1 to reset the first node 1, that is, to discharge the capacitance C. Since the data signal Data is at a low level at this time, the second compensation element T5 is turned on by the data signal Data transmitted to the first node 1, the driving transistor DT is turned off by the data signal Data transmitted to the first node 1, the third switching element T3 is turned on by the third scan signal Scan3, and the second power signal VSS is transmitted to the second node 2 through the third switching element T3 to reset the second node 2, that is, to reset the first electrode of the electroluminescent element L. The first compensation element T4 is turned on by the second power signal VSS transmitted to the second node 2, and the second switching element T2 is turned off by the second scan signal Scan2. It can be seen from the above procedure that both the capacitor C and the first electrode of the electroluminescent element L are reset during the reset phase (i.e., the t1 phase), and thus the influence of the previous frame signal on the display brightness can be eliminated.

Figure 5:
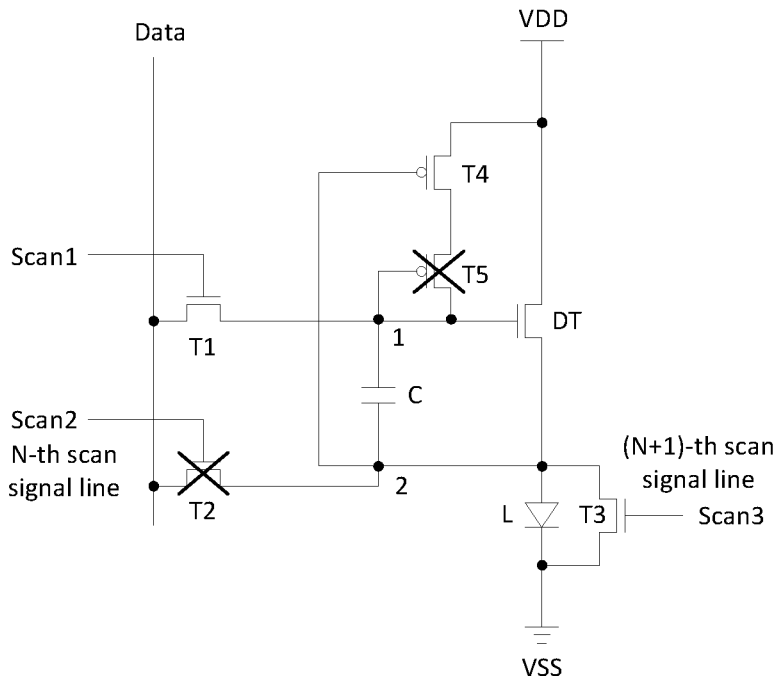
FIG. 5 is an equivalent circuit diagram of a pixel driving circuit in a pre-charging phase according to an exemplary embodiment of the present disclosure.

In the pre-charging phase (i.e., the t2 phase), the first scan signal Scan1, the third scan signal Scan3, the data signal Data, and the first power signal VDD are all at the first level, and the second scan signal Scan2 is at the second level. The first switching element T1 is turned on by the first scan signal Scan1 to transmit the data signal Data to the first node 1 to charge the capacitor C. The second compensation element T5 is turned off under the action of the data signal Data. The third switching element T3 is turned on by the third scan signal Scan3 to transmit the second power signal VSS to the second node 2, so that the first compensation element T4 is turned on by the second power signal VSS. In the present exemplary embodiment, the first scan signal Scan1 and the third scan signal Scan3, the data signal Data, and the first power signal VDD are both at a high level, and the second scan signal Scan2 is at a low level. As shown in FIG. 5, the second switching element T2 is turned off by the second scan signal Scan2, and the third switching element T3 is turned on by the third scan signal Scan3 to transmit the second power signal VSS to the second node 2. Since the second power signal VSS is at a low level, the first compensation element T4 is turned on by the second power signal VSS transmitted to the second node 2, and the first switching element T1 is turned on by the first scan signal Scan1. The data signal Data is transmitted to the first node 1 to charge the first terminal of the capacitor C, so that the signal at the first terminal of the storage capacitor C becomes the data signal Data, that is, the signal at the first node becomes the data signal Data. Since the data signal Data is at a high level, the second compensation element T5 is turned off by the data signal Data transmitted to the first node 1, and the driving transistor DT is turned on under the action of the data signal Data transmitted to the first node 1.

Figure 6:
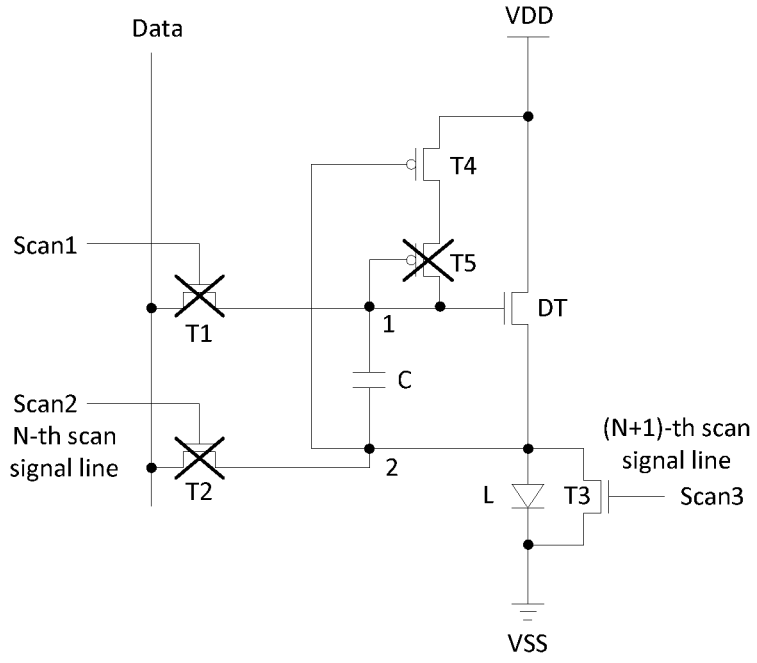
FIG. 6 is an equivalent circuit diagram of a pixel driving circuit in a writing phase according to an exemplary embodiment of the present disclosure.

In the writing phase (i.e., the t3 phase), the first scan signal Scan1, the second scan signal Scan2, and the data signal Data are all at the second level, the third scan signal Scan3 and the first power signal VDD are at the first level. The third switching element T3 is turned on by the third scan signal Scan3 to transmit the second power signal VSS to the second node 2, so that the first compensation element T4 is turned on by the second power signal VSS. The driving transistor DT is turned on by the data signal Data stored in the capacitor C, so that the data signal Data stored in the capacitor C is dropped through the drive transistor DT to the threshold voltage Vth of the drive transistor DT. In the present exemplary embodiment, the first scan signal Scan1, the second scan signal Scan2, and the data signal Data are all at a low level, and the third scan signal Scan3 and the first power signal VDD are both at a high level, as shown in FIG. 6. The first switching element T1 is turned off by the first scan signal Scan1, the second switching element T2 is turned off by the second scan signal Scan2, and the third switching element T3 is turned on under the action of the third scan signal Scan3. The second power signal VSS is transmitted to the second node 2 through the third switching element T3, and the first compensation element T4 is turned on by the second power signal VSS transmitted to the second node 2. Since the capacitor C stores the data signal Data in the charging phase (i.e., the t2 phase), the driving transistor DT is turned on by the data signal Data stored in the capacitor C. At this time, the data signal Data stored in the capacitor C is lowered through the driving transistor DT to the threshold voltage Vth of the driving transistor DT, that is, the signal at the first node 1 falls from the data signal Data to the threshold voltage Vth of the driving transistor DT. It should be noted that when the signal of the first node 1 falls to the threshold voltage Vth of the driving transistor DT, the driving transistor DT is turned off.

Figure 7:
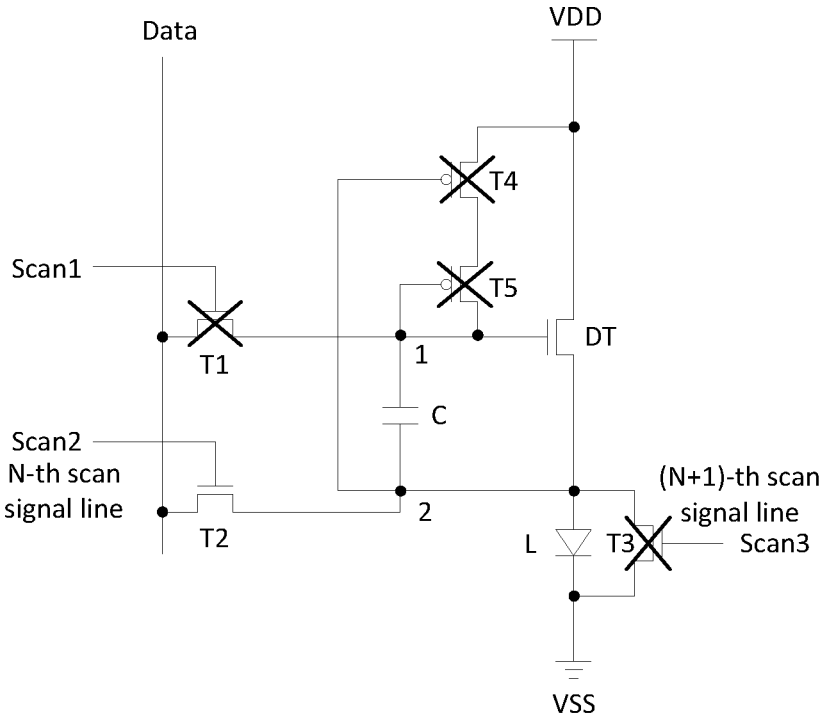
FIG. 7 is an equivalent circuit diagram of a pixel driving circuit in a bootstrap light-emitting phase according to an exemplary embodiment of the present disclosure.

In the bootstrap light-emitting phase (i.e., the t4 phase), the second scan signal Scan2, the data signal Data, and the first power signal VDD are all at the first level, and the first scan signal Scan1 and the third scan signal Scan3 are at the second level. The second switching element T2 is turned on by the second scan signal Scan2, so that the data signal Data is transmitted to the second node 2, and the signal at the first node 1 is bootstrapped from the threshold voltage Vth of the driving transistor DT to the sum of the threshold voltage Vth of the driving transistor DT and the data signal Data under the bootstrap action of the capacitor C. The driving transistor DT is turned on by the signal of the first node 1, and outputs a driving current under the action of the first power signal VDD to drive the electroluminescent element L to emit light. In the present exemplary embodiment, the first scan signal Scan1 and the third scan signal Scan3 are at a low level, and the second scan signal Scan2, the data signal Data, and the first power signal VDD are at a high level, as shown in FIG. 7. The first switching element T1 is turned off by the first scan signal Scan1, the third switching element T3 is turned off by the third scan signal Scan3, and the second switching element T2 is turned on by the second scan signal Scan2. The data signal Data is transmitted to the second node 2 through the second switching element T2. At this time, the signal at the second node 2 is the data signal Data. Under the bootstrap action of the capacitor C, the signal of the first node 1 is pulled up from the threshold voltage Vth of the driving transistor DT to the sum of the threshold voltage Vth of the driving transistor DT and the data signal Data. Since the signals of the first node 1 and the second node 2 are both high level signals, the first compensation element T4 and the second compensation element T5 are turned off. The driving transistor DT is turned on by the signal of the first node 1 (i.e., the sum of the threshold voltage Vth of the driving transistor DT and the data signal Data), and outputs a driving current under the action of the first power supply signal VDD. When the driving transistor DT is turned on, the voltage at the first terminal of the drive transistor DT becomes VDD.

On this basis, the calculation formula of the driving current of the driving transistor DT may be as follows:

$$\begin{aligned} \text{Ion} &= K \times (Vgs - Vth)^2 = K \times (Vg - Vs - Vth)^2 \\ &= K \times (\text{Data} + Vth - VDD - Vth)^2 \\ &= K \times (\text{Data} - VDD)^2 \end{aligned}$$

Here, Vgs is the voltage difference between the gate and the source of the drive transistor DT, Vg is the gate voltage of the drive transistor DT, and Vs is the source voltage of the drive transistor DT.

It can be seen from the calculation formula of the driving current of the driving transistor DT that the driving current of the driving transistor DT is independent of the threshold voltage Vth of the driving transistor DT. Thus, the influence of the threshold voltage Vth of the driving transistor DT on the driving current can be eliminated, thereby ensuring the uniformity of the display brightness of pixels (in other words, the brightness of the pixels can be consistent).

In summary, the capacitor C is charged by the data signal Data; in the writing phase (i.e., the t3 phase), the driving transistor DT is turned on by the data signal Data stored in the capacitor C, so that the data signal Data stored in the capacitor C is dropped to the threshold voltage Vth of the driving transistor DT so as to write the threshold voltage Vth of the driving transistor DT to the first node 1, thereby eliminating the influence of the threshold voltage Vth of the driving transistor DT on the driving current and ensuring uniformity of display brightness of pixels. On the other hand, in the reset phase (i.e., stage t1), the first switching element T1 and the third switching element T3 are turned on by the first scan signal Scan1 and the third scan signal Scan3 to transmit the data signal Data to the first node 1, and to transmit the second power signal VSS to the second node 2, so as to reset the first node 1 by the data signal Data (i.e., to discharge the capacitor C) and reset the second node 2 by the second power signal VSS. Thus, the influence of the previous frame signal on the display brightness can be eliminated.

It should be noted that, in the foregoing embodiments, all the switching elements and the driving transistors are N-type thin film transistors, and all of the compensation elements are P-type thin film transistors; however, those skilled in the art can easily think of that in the pixel driving circuit according to embodiments of the present disclosure, all switching elements and driving transistors may also be P-type thin film transistors, and all compensation elements may also be N-type thin film transistors. The use of P-type thin film transistors has the following advantages. For example, strong noise suppression may be realized. For example, the P-type thin film transistors are turned on by low levels, and low levels in charge management are relatively easy to implement. For another example, the manufacturing processes of P-type thin film transistors are simple and relatively low in price. For another example, P-type thin film transistors are relatively reliable.

Of course, the pixel driving circuit provided by embodiments of the present disclosure may be changed to a CMOS (Complementary Metal Oxide Semiconductor) circuit or the like, and is not limited to the pixel driving circuit provided herein, and details are not described here again.

Figure 10:
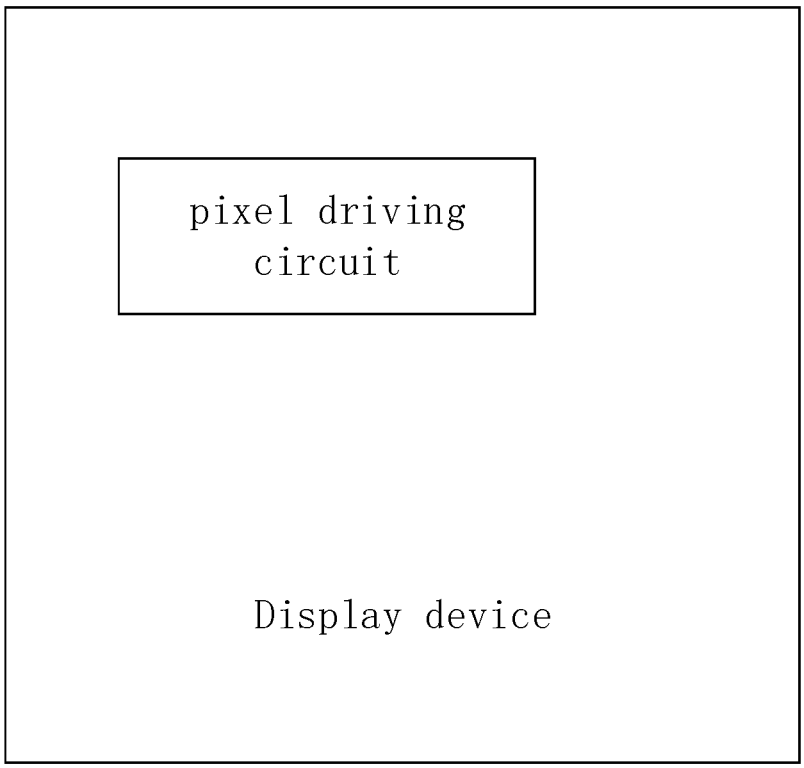
FIG. 10 shows a display device according to an exemplary embodiment of the present disclosure.

An exemplary embodiment of the present disclosure also provides a display device including the above-described pixel driving circuit, as shown in FIG. 10. The display device includes: a plurality of scan lines for providing scan signals; a plurality of data lines for providing data signals; and a plurality of pixel driving circuits electrically connected to the scan lines and the data lines. At least one of the pixel driving circuits is one of the pixel driving circuits as described in the above exemplary embodiments. In the pixel driving circuit, the capacitor is charged by the data signal; in the writing phase, the driving transistor is turned on by the data signal stored in the capacitor, so that the data signal stored in the capacitor is dropped to the threshold voltage of the driving transistor so as to write the threshold voltage of the driving transistor to the first node, thereby eliminating the influence of the threshold voltage of the driving transistor on the driving current and ensuring uniformity of display brightness of pixels. On the other hand, in the reset phase, the first switching element and the third switching element are turned on by the first scan signal and the third scan signal to transmit the data signal to the first node and to transmit the second power signal to the second node, so as to reset the first node by the data signal (i.e., to discharge the capacitor) and reset the second node—by the second power signal. Thus, the influence of the previous frame signal on the display brightness can be eliminated. The display device may include any product or component having a display function, for example, a mobile phone, a tablet computer, a television, a notebook computer, a digital photo frame, a navigator, or the like.

It should be noted that the specific details of each module unit in the display device have been described in detail in the embodiments of the pixel driving circuit, and thus repeated descriptions will be omitted.

It should be noted that although several modules or units of equipment for action execution are mentioned in the detailed description above, such division is not mandatory. Indeed, in accordance with embodiments of the present disclosure, the features and functions of two or more modules or units described above may be embodied in one module or unit. Conversely, the features and functions of one of the modules or units described above may be further divided into multiple modules or units.

In addition, although various steps of methods of the present disclosure are described in a particular order in the drawings, this is not required or implied that the steps must be performed in the specific order, or all the steps shown must be performed to achieve the desired results. Additionally or alternatively, certain steps may be omitted, multiple steps may be combined into one step, and/or one step may be decomposed into multiple steps.

Other embodiments of the present disclosure will be apparent to those skilled in the art when considering the specification and practicing the invention disclosed herein. The present application is intended to cover any variations, uses, or adaptations of the present disclosure, which are in accordance with the general principles of the present disclosure and include common knowledge or customary means in the art that are not disclosed in the present disclosure. The specification and examples are intended to be regarded as illustrative only, and the true scope and spirit are defined by the appended claims.

What is claimed is:

1. A pixel driving circuit, comprising:

a first switching element, wherein a control terminal of the first switching element receives a first scan signal, a first terminal of the first switching element is connected to a first node, and a second terminal of the first switching element receives a data signal;

a second switching element, wherein a control terminal of the second switching element receives a second scan signal, a first terminal of the second switching element is connected to a second node, and a second terminal of the second switching element receives the data signal;

a first compensation element, wherein a control terminal of the first compensation element is connected to the second node, and a second terminal of the first compensation element receives a first power signal;

a second compensation element, wherein a control terminal and a first terminal of the second compensation element are both connected to the first node, and a second terminal of the second compensation element is connected to a first terminal of the first compensation element;

a driving transistor, where a control terminal of the driving transistor is connected to the first node, a first terminal of the driving transistor is connected to a first electrode of an electroluminescent element, and a second terminal of the driving transistor receives the first power signal;

a capacitor, wherein a first terminal of the capacitor is connected to the control terminal of the driving transistor, and a second terminal of the capacitor is connected to the first terminal of the driving transistor;

a third switching element, wherein a control terminal of the third switching element receives a third scan signal, a first terminal of the third switching element is connected to a second electrode of the electroluminescent element and receives a second power signal, and a second terminal of the third switching element is connected to the first terminal of the driving transistor;

wherein turn-on levels of the first compensation element and the second compensation element are opposite to turn-on levels of the first switching element, the second switching element, the driving transistor, and the third switching element.

2. The pixel driving circuit according to claim 1, wherein the pixel driving circuit is connected to an N-th scan signal line and an (N+1)-th scan signal line, the N-th scan signal line is configured to output the second scan signal, and the (N+1)-th scan signal line is configured to output the third scan signal; where N is a positive integer.

3. The pixel driving circuit according to claim 1, wherein the first to third switching elements and the driving transistor are N-type thin film transistors, and the first and second compensation elements are P-type thin film transistors.

4. The pixel driving circuit according to claim 3, wherein the thin film transistors are one of amorphous silicon thin film transistors, poly-silicon thin film transistors, and amorphous-indium gallium zinc oxide thin film transistors.

5. The pixel driving circuit according to claim 1, wherein the first to third switching elements and the driving transistor are P-type thin film transistors, and the first and second compensation elements are N-type thin film transistors.

6. A pixel driving method for driving the pixel driving circuit of claim 1, wherein the pixel driving method comprises:

in a reset phase where the first scan signal and the third scan signal are both at a first level, and the second scan signal, the data signal and the first power signal are both at a second level, turning on the first switching element by the first scan signal to transmit the data signal to the first node, so that the second compensation element is turned on under action of the data signal, and turning on the third switching element by the third scan signal to transmit the second power signal to the second node so that the first compensation element is turned on under action of the second power signal;

in a pre-charging phase where the first scan signal, the third scan signal, the data signal, and the first power signal are all at the first level and the second scan signal is at the second level, turning on the first switching element by the first scan signal to transmit the data signal to the first node to charge the capacitor, turning off the second compensation element under action of the data signal, turning on the third switching element by the third scan signal to transmit the second power signal to the second node, so that the first compensation element is turned on under action of the second power signal;

in a writing phase where the first scan signal, the second scan signal and the data signal are all at the second level, and the third scan signal and the first power signal are both at the first level, turning on the third switching element by the third scan signal to transmit the second power signal to the second node, so that the first compensation element is turned on under action of the second power signal, turning on the driving transistor under action of the data signal stored in the capacitor, so that the data signal stored in the capacitor is dropped to a threshold voltage of the driving transistor through the driving transistor;

in a bootstrap light-emitting phase where the second scan signal, the data signal, and the first power signal are all at the first level, and the first scan signal and the third scan signal are at the second level, turning on the second switching element by the second scan signal, so that the data signal is transmitted to the second node, and bootstrapping a signal of the first node from the threshold voltage of the driving transistor to a sum of the threshold voltage of the driving transistor and the data signal under bootstrap of the capacitor, and turning on the driving transistor by the signal of the first node, so that the driving transistor outputs driving current under action of the first power signal to make the electroluminescent element emits light;

wherein the first switching element to the third switching element and the driving transistor are turned on under action of the first level, the first compensation element and the second compensation element are turned off under action of the first level, the first switching element to the third switching element and the driving transistor are turned off under action of the second level, and the first compensation element and the second compensation element are turned on under action of the second level.

7. The pixel driving method according to claim 6, wherein the first to third switching elements and the driving transistor are N-type thin film transistors, the first and second compensation elements are P-type thin film transistors, the first level is a high level and the second level is a low level.

8. The pixel driving method according to claim 7, wherein the thin film transistors are one of amorphous silicon thin film transistors, poly-silicon thin film transistors, and amorphous-indium gallium zinc oxide thin film transistors.

9. The pixel driving method according to claim 6, wherein the first to third switching elements and the driving transistor are P-type thin film transistors, the first and second compensation elements are N-type thin film transistors, the first level is a low level, and the second level is a high level.

10. A display device comprising a pixel driving circuit; wherein the pixel driving circuit comprises:

a first switching element, wherein a control terminal of the first switching element receives a first scan signal, a first terminal of the first switching element is connected to a first node, and a second terminal of the first switching element receives a data signal;

a second switching element, wherein a control terminal of the second switching element receives a second scan signal, a first terminal of the second switching element is connected to a second node, and a second terminal of the second switching element receives the data signal;

a first compensation element, wherein a control terminal of the first compensation element is connected to the second node, and a second terminal of the first compensation element receives a first power signal;

a second compensation element, wherein a control terminal and a first terminal of the second compensation element are both connected to the first node, and a second terminal of the second compensation element is connected to a first terminal of the first compensation element;

a driving transistor, where a control terminal of the driving transistor is connected to the first node, a first terminal of the driving transistor is connected to a first electrode of an electroluminescent element, and a second terminal of the driving transistor receives the first power signal;

a capacitor, wherein a first terminal of the capacitor is connected to the control terminal of the driving transistor, and a second terminal of the capacitor is connected to the first terminal of the driving transistor;

a third switching element, wherein a control terminal of the third switching element receives a third scan signal, a first terminal of the third switching element is connected to a second electrode of the electroluminescent element and receives a second power signal, and a second terminal of the third switching element is connected to the first terminal of the driving transistor;

wherein turn-on levels of the first compensation element and the second compensation element are opposite to turn-on levels of the first switching element, the second switching element, the driving transistor, and the third switching element.

11. The display device according to claim 10, wherein the pixel driving circuit is connected to an N-th scan signal line and an (N+1)-th scan signal line, the N-th scan signal line is configured to output the second scan signal, and the (N+1)-th scan signal line is configured to output the third scan signal; where N is a positive integer.

12. The display device according to claim 10, wherein the first to third switching elements and the driving transistor are N-type thin film transistors, and the first and second compensation elements are P-type thin film transistors.

13. The display device according to claim 12, wherein the thin film transistors are one of amorphous silicon thin film transistors, poly-silicon thin film transistors, and amorphous-indium gallium zinc oxide thin film transistors.

14. The display device according to claim 10, wherein the first to third switching elements and the driving transistor are P-type thin film transistors, and the first and second compensation elements are N-type thin film transistors.

* * * * *